US005537699A

United States Patent [19]

Bonaddio et al.

[11] Patent Number: 5,537,699

[45] Date of Patent: Jul. 23, 1996

[54] MATTRESS BORDER ASSEMBLY AND METHOD OF MAKING SAME

[75] Inventors: Vincenzo A. Bonaddio, Rancho Santa Margarita; Jose D. M. Contreras, Orange, both of Calif.

[73] Assignee: Foamex L.P., Orange, Calif.

[21] Appl. No.: 446,216

[22] Filed: May 22, 1995

[51] Int. Cl.[6] ..... A47C 27/20

[52] U.S. Cl. ..... 5/474; 5/477; 5/480; 5/481

[58] Field of Search ..... 5/451, 462, 464, 5/474, 477, 481, 260, 480

[56] References Cited

U.S. PATENT DOCUMENTS

| | | | |
|---|---|---|---|
| 912,456 | 2/1909 | Fischman . | |
| 1,192,510 | 7/1916 | Fischmann | 5/477 |
| 1,393,755 | 10/1921 | Conlan . | |
| 1,683,684 | 9/1928 | MacInerney . | |
| 1,870,045 | 8/1952 | Gail | 5/474 |
| 1,914,661 | 6/1933 | Burke . | |
| 2,425,728 | 8/1947 | Cobb | 5/464 X |
| 3,618,146 | 11/1971 | Ferdinand . | |
| 3,656,193 | 4/1972 | Schneider . | |
| 3,822,426 | 7/1974 | Mistarz . | |
| 4,110,881 | 9/1978 | Thompson . | |
| 4,245,362 | 1/1981 | Mueller . | |
| 4,245,363 | 1/1981 | Callaway . | |
| 4,286,344 | 9/1981 | Ikeda . | |
| 4,389,743 | 6/1983 | Callaway . | |
| 4,462,129 | 7/1984 | Brannock . | |
| 5,111,542 | 5/1992 | Farley . | |

FOREIGN PATENT DOCUMENTS

| | | |
|---|---|---|
| 2646772 | 11/1990 | France . |
| 1559851 | 1/1980 | United Kingdom . |

*Primary Examiner*—Michael F. Trettel
*Attorney, Agent, or Firm*—Connolly and Hutz

[57] ABSTRACT

A mattress border construction includes a foam rail sleeve encasing a single row of coil springs so that the top, bottom and sides of the row of springs are surrounded by foam. The row of coil springs is inserted into the hollow inner core of a foam rail sleeve. Preferably, a longitudinal slit is cut through the side wall of the foam rail sleeve to facilitate insertion of the row of springs into the inner core of the foam rail sleeve. The slit is then sealed closed with a suitable adhesive. Several border assemblies are positioned around a center body-supporting mattress portion, which may be a foam, spring coil or water mattress. The mattress center sections and borders may be joined together with adhesive, and are wrapped in a sheet of fabric or other covering material that is staple fastened to the core components. A welt cord may then be stitched around the border edges at top and bottom of the mattress. The combination of springs surrounded by foam has better side to side stability and body support than prior border constructions.

23 Claims, 3 Drawing Sheets

MATTRESS BORDER ASSEMBLY AND METHOD OF MAKING SAME

BACKGROUND OF THE INVENTION

Mattress border constructions stabilize the edge or border portion of the mattress and are used in conjunction with mattress center portions. It is desirable to have a more firm or more rigid border portion surrounding a less firm body supporting mattress center portion. Presently, it is believed that the optimum border stiffness may be achieved by placing two rows of spring coils fastened side-by-side along the outer edges of the mattress. The two rows of springs, substantially firmer than a single row, form a border rail. Mattress border constructions of various types have been disclosed in the prior art.

For example, U.S. Pat. No. 1,393,755 discloses a mattress having a border formed by coil springs connected together by fabric and then wrapped in felt. Similarly, U.S. Pat. No. 912,456 shows a mattress construction in which pocketed coil springs are wrapped with raw cotton webbing, felt or batting.

More recently, U.S. Pat. No. 4,462,129 discloses a mattress border construction with a plurality of rows of pocketed coil springs and a flat wire attached with hog rings to the upper convolution of each spring coil. Additional round border wires surround the rows of pocketed coil springs. A foam pad is placed on top of the flat wire and a C-shaped foam piece may be provided around a portion of the pocketed coil springs, border wires and flat wire.

U.S. Pat. No. 4,389,743 shows a mattress with a rigid border having a plurality of coil springs that may be pocketed and interconnected together with fabric strips. The inner mattress core section is removably inserted into the rigid border.

U.S. Pat. No. 3,618,146 discloses a mattress border stabilizer in which resilient foam is inserted between adjacent convolutions of each of the coils in a peripheral row of coils in the mattress. The foam so inserted into the coils stiffens the coils at the border edge of the mattress.

Finally, U.S. Pat. No. 3,822,426 shows a mattress construction which has a one-piece combined foam topper and border stabilizer that is folded so that one section extends between the convolutions of each of the coils adjacent to the mattress edge. The foam stiffens the coils at the border edge of the mattress.

None of the prior mattress border constructions show a single row of springs inserted into a foam rail sleeve and completely surrounded by foam.

SUMMARY OF THE INVENTION

A mattress border assembly construction has a foam rail sleeve with a hollowed inner core and a plurality of springs arranged in a row held within the core of the rail sleeve. The springs may be encased within a fabric cover or fiber mat, with each individual spring is held within an individual pocket formed in the cover. Alternatively, the springs may be connected together to form a row with wire or string or other means known in the art. This row of springs is inserted into and held within the rail sleeve, so that the row is completely surrounded by foam at the top, bottom and sides of the row. The foam of the sleeve does not, however, extend into the coils of the springs or between adjacent convolutions of the springs when no weight is applied to the surface of the mattress and the springs are at rest.

The border assembly is placed adjacent to one edge of the central body-supporting mattress portion. Preferably, four border assemblies are used in the mattress construction with one on each side edge of the central mattress portion to form a contiguous outer or edge border of the mattress construction. The central mattress portion may be a coil spring mattress, or a water mattress, or a foam mattress pad or combination of these, all as known in the art. The border assembly and central mattress portion may be joined together with a spray adhesive and enclosed in a covering sheet, which may be quilted or stitched. Alternatively, the border assembly and central mattress portion are held within a frame and the combination will be enclosed in a covering sheet that may be quilted or stitched. The covering sheet preferably is staple fastened to the core components and then a welt cord is stitched around the top and bottom of the mattress construction to hold the mattress construction together. Such covering sheet may be fabric, vinyl or other suitable sheet material.

The border assembly preferably is made by providing a foam rail sleeve, preferably of polyurethane foam, that has a hollow inner core. A slit is cut longitudinally through the side wall of the foam rail sleeve. The slit can be cut at an angle from a reference line perpendicular to the side wall surface, preferably the angle with be in the range of about 20 to 70 degrees, most preferably about 40 to 50 degrees to provide a greater foam surface area at the cut. A plurality of springs, arranged in a row, is placed within the hollowed core of the rail sleeve. The row of springs may be encased in a fabric cover with each spring held within an individual pocket of the fabric cover. To insert the row of springs into the sleeve, the sleeve may be held open at the slit to facilitate insertion of the row of springs. Thereafter, adhesive is applied to the slit to seal it closed. If the foam rail sleeve was cored to have openings also at its ends, foam plugs are inserted into those openings to seal the open ends. The plugs may be held with adhesive. The row of springs is thus completely surrounded with the foam of the foam rail sleeve.

This new combination of coil springs surrounded by foam provides a firmer, but still comfortable border section. A single row of spring coils achieves the desired stiffness of prior double row spring coil rail constructions in part by virtue of the stabilizing effect added by the foam surrounding the single row. The foam encapsulates the row of springs to provide enhanced comfort and body acceptance area. This construction will often have greater side to side stability and support than prior border constructions with unwrapped or loosely wrapped spring coils. Unlike prior borders where the foam was nestled in between spring coils or the springs were wrapped with batting or felt, the foam surrounding the row of springs does not interfere with individual spring deflection. Moreover, the improved border construction is more easily and cheaply assembled than any of the prior border constructions known heretofore.

DESCRIPTION OF THE PREFERRED EMBODIMENT

Figure 1:
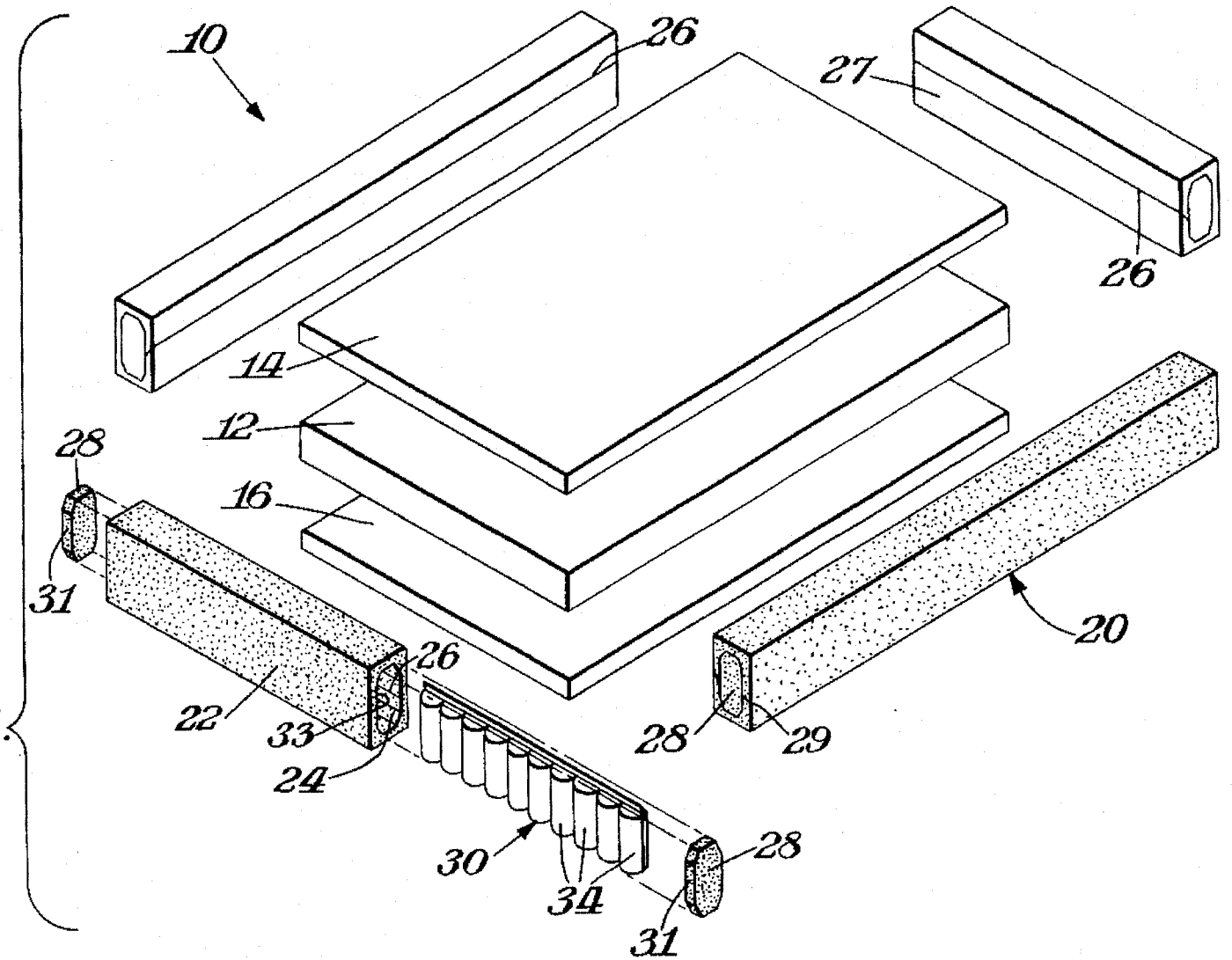
FIG. 1 is an exploded perspective view of a mattress construction including a spring coil border rail assembly according to the invention.
Figure 3:
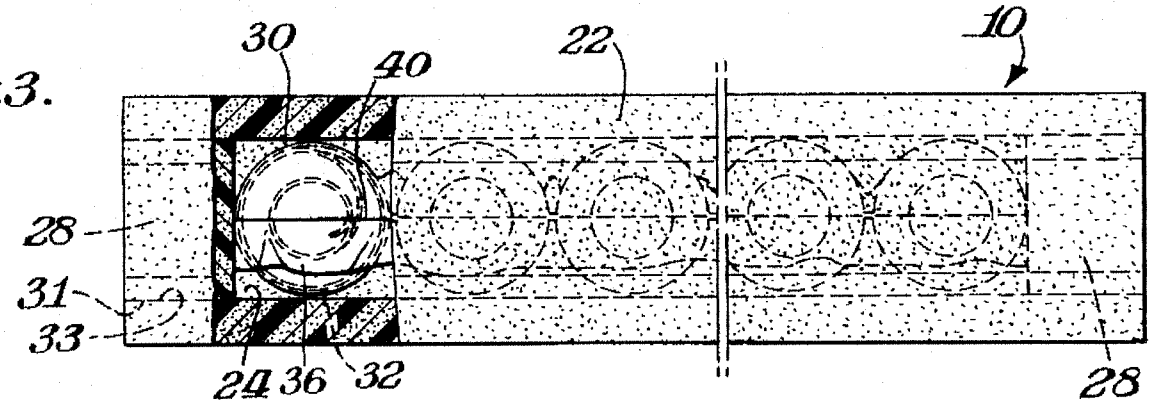
FIG. 3 is a top plan view partially broken away of the spring coil border rail assembly components shown in FIG. 2.

Referring first to FIG. 1, there is shown a mattress construction 10 composed of an intermediate mattress section 12 sandwiched between an upper mattress section 14 and a lower mattress section 16. The intermediate, upper and lower mattress sections 12–16, are fabricated of foam, preferably polyurethane foam of a density in the range of about 1.3 to 2.6 lbs. per cubic foot. Variations in foam density above and below this range are possible for other embodiments of the invention. The surfaces of the upper and lower mattress sections 14 and 16 may be convoluted or cut to a desired pattern in a manner known to those of skill in foam fabrication. If not foam, the intermediate mattress section 12, however, may be formed as a coil spring mattress or a water-filled mattress, or a combination of foam, coil spring and water-filled mattress.

Four spring coil border rail assemblies 20 surround the periphery of the intermediate, upper and lower mattress sections 12–16. Each spring coil rail assembly 20 has a foam rail sleeve 22 made preferably of polyurethane foam of a density in the range of about 1.8 to 2.6 lbs. per cubic foot and $IFD_{25}$ in the range of about 40 to 50 pounds per 50 square inches. The indentation force deflection at 25% ($IFD_{25}$) is defined as the force in pounds required to indent a standard sample size (4 inches thick, 15 inches wide and 15 inches long) to 25% of the actual thickness using a round platen with a 50 square inch surface area. The sleeve 20 has a hollow inner core 24 and a longitudinal slit 26 cut through the side wall of the sleeve. The hollow inner core 24 may fully extend through the rail sleeve 20, leaving openings in each end wall 20 of the sleeve.

Figure 2:
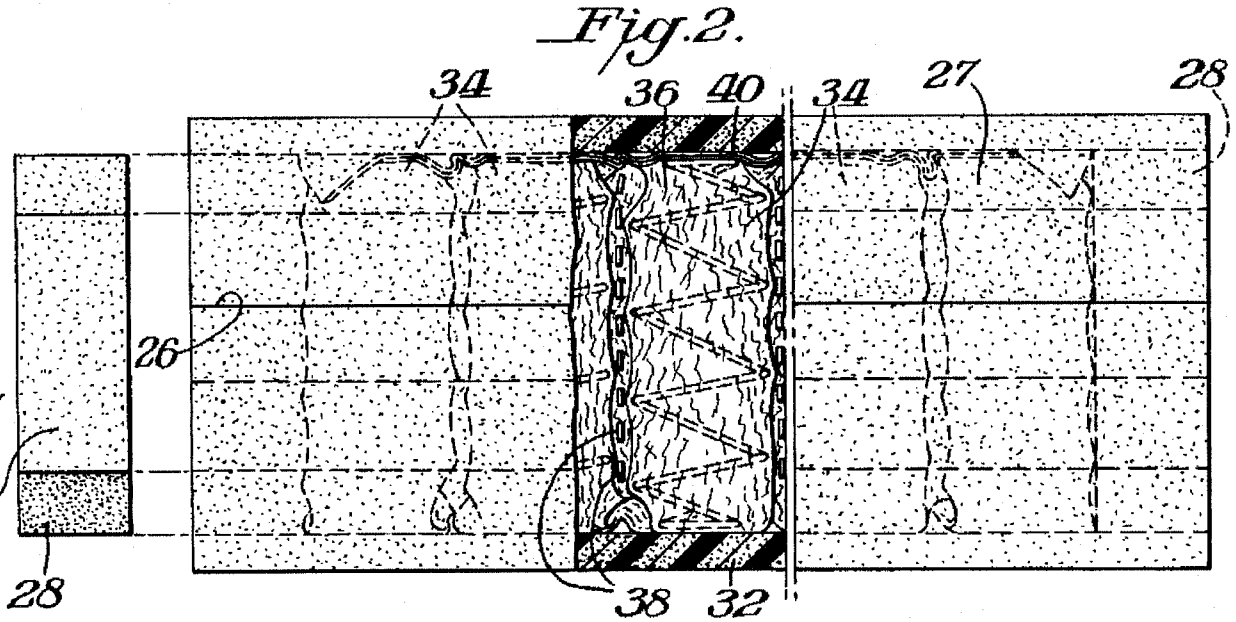
FIG. 2 is a side elevational view partially broken away to show the spring coil border rail assembly components with the left closure plug exploded from the assembly.

In this preferred embodiment spring assembly 30 is formed with a plurality of coil springs 32 of the type conventionally provided in mattresses and a fabric or fiber mat material sheet 36. The springs 32 are aligned in a row and encased in pockets 34 formed in the sheet 36 as shown in FIG. 2. Preferably, the fabric or fiber sheet is wrapped around the row of coil springs 32 so that the selvage ends of the sheet meet at the top of the springs. The cut side edges of the fabric sheet meet as well. The selvage ends are either sewn together or held together by heat sealing 40. Similarly, the side edges are sewn or heat sealed together. The fabric or fiber sheet is also cinched or heat sealed 38 together between each spring to form individual pockets in the sheet that encase the individual springs. In the preferred embodiment, each spring is held within its own individual pocket compartment in the fabric or fiber sheet. A spring assembly in which the spring coils are not pocketed in a fabric cover could also be used in the present invention.

The spring assembly 30 is inserted into the hollow inner core 24 and the openings in the end walls of the sleeve, if present, are plugged with end plugs 28. The end plugs 28 may be fabricated from polyurethane foam of the same grade as that used to make the foam rail sleeve 22. Preferably, the plugs 28 are inserted into the openings in the end walls of the sleeve. The side edges 31 of the plugs are sealed with an adhesive to the side edges 33 of the opening in the spring coil rail sleeve end walls 29. An adhesive known to be suitable for foam-to-foam applications will be most suitable. Such adhesive may be solvent-based, water-based or a hot melt.

Once inserted into the rail, the row of springs is completely surrounded by foam at its top, bottom and sides. In the preferred embodiment, there is about one-half inch thickness of polyurethane foam of density 1.8 to 2.6 lbs. per cubic foot and $IFD_{25}$ of about 40 to 50 pound per 50 square inches surrounding the row of springs. Depending upon the specific coil springs and the polyurethane foam selected for use in the border construction, the thickness and other dimensions of the rail may be varied to achieve desired support characteristics. In addition, polyurethane foams having a density and $IFD_{25}$ outside of the identified ranges may still be used in this invention.

Figure 4:
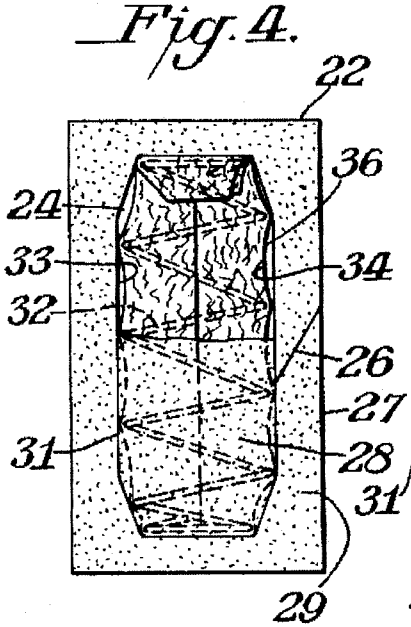
FIG. 4 is a left end elevational view partially broken away of the spring coil border rail assembly components shown in FIGS. 2–3.
Figure 6:
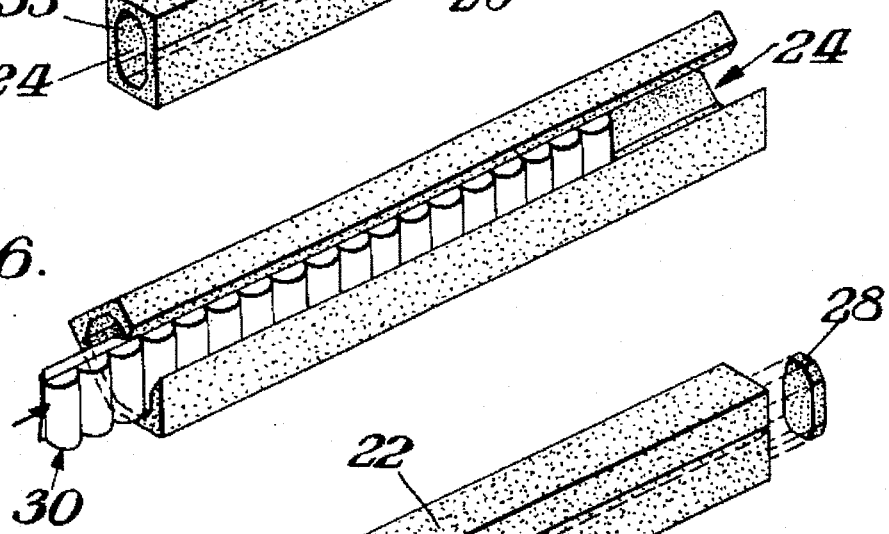
FIG. 6 is a perspective view showing the spring coil rail sleeve opened and showing a row of pocketed springs being inserted into the core of the spring coil rail sleeve.
Figure 7:
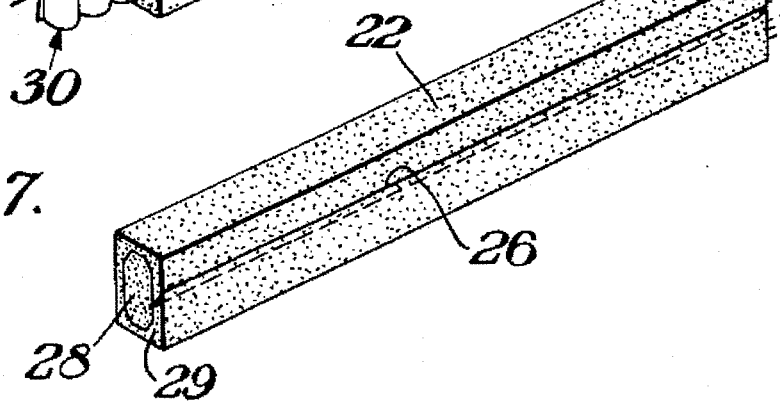
FIG. 7 is a perspective view of the spring coil rail with adhesive applied to seal the longitudinal slit in the sleeve and plugs to cover the openings in each end of the spring coil rail sleeve.

In a preferred method of making the mattress border, the foam rail sleeves are formed in a generally rectangular or bar shape. The side walls have a longer length than width. The inner core of the sleeve is hollowed out as shown in FIG. 4. This hollowed core has a generally hexagonal shape, but it may have any other desired and suitable cross-sectional shape, so long as the plurality of springs may be held within such hollowed core. For the preferred embodiment, a block of foam was contour cut to form the rail. The final desired shape for the interior and the exterior of the rail was programmed so that the exterior surfaces were cut straight and the foam was cut from the interior of the rail with a blade that can rotate on its axis.

Figure 5:
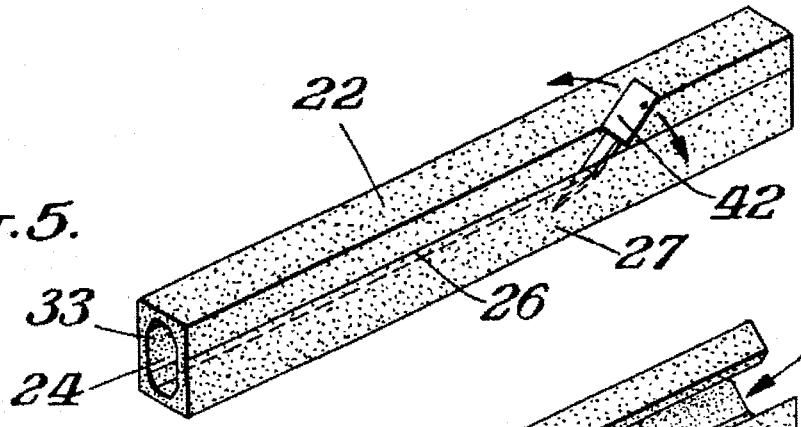
FIG. 5 is a perspective view showing a spring coil rail sleeve that has been cored and is in the process of being longitudinally slit.
Figure 5A:
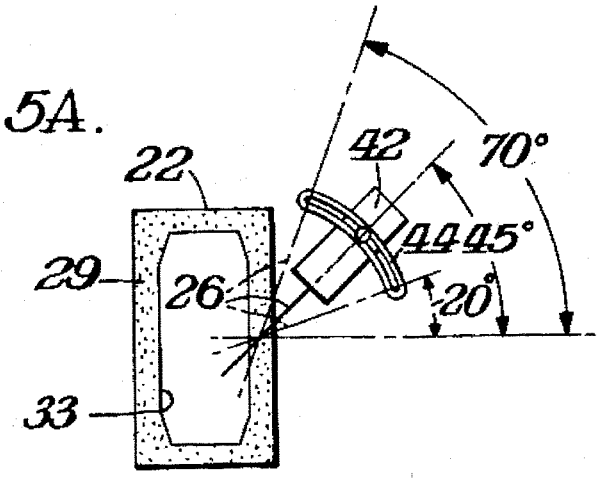
FIG. 5A is a left end elevational view of the spring coil rail sleeve showing the range of angles to set a blade to cut the longitudinal slit.

A longitudinal slit 26 is cut through one side wall with a blade 42 that can rotate on its axis. Most preferably, as shown in FIG. 5A, the blade 42 is set with an adjustment device 44 at an angle other than perpendicular to the side wall 27 of the sleeve 22. This angle should be in the range of about 20 to 70 degrees, most preferably about 40 to 50 degrees, as measured from a reference line taken perpendicular to the side wall. In this preferred method, the blade 42 cuts through only the one side wall 27 of the spring coil rail sleeve 22. Foam cutting methods other than using a blade, such as hot wire or laser cutting, may be employed to cut the longitudinal slit through the side wall.

The sleeve 22 is then opened at the slit to facilitate insertion of the row of springs 30 into the sleeve 22. After the spring coils are inserted, the sleeve 22 is sealed with adhesive at the slit 26. Any adhesive recommended for foam to foam applications would be suitable. A spray adhesive was used to seal the slit in the rail of the preferred embodiment. Where the slit has been cut by a blade held at an angle other than perpendicular to the side wall surface, the slit portions are more easily sealed together because adhesive may be applied to a greater surface area of the slit surfaces. Plugs 28 are then inserted into the openings, if present, in the end walls 29 of the sleeve to seal those openings. The plugs are held in the end walls with a suitable adhesive.

To form the mattress construction using the border assembly of the invention, the spring coil border rail assemblies 20 are placed around the periphery of the central body-supporting mattress sections 12–16. Preferably, the side walls of the spring coil border rail assemblies 20 that are slit along a longitudinal line are positioned with the slit side wall adjacent to the central body-supporting mattress sections. For the rectangular shaped standard mattress construction of the preferred embodiment, four border assemblies surround the central body-supporting mattress sections. The border assemblies and center portion are together wrapped or covered with a fabric or other material that can be staple fastened to the core components. A welt cord is then stitched at top and bottom to hold the construction together.

For mattress constructions formed entirely of foam, the border assemblies may alternatively first be joined or attached to the central body supporting mattress sections with adhesive before the border assemblies and central body supporting mattress sections are covered with fabric or cover material. The ends of the border assemblies may be formed to interlock with one another with or without adhesive. For spring coil mattresses, the border assemblies may fit within or attach to a frame around the center portion of the mattress. If the central mattress portion is a water or air bladder assembly, the border assembly could be fastened to a bottom panel that is provided to cover the entire surface area of the mattress.

While the present invention has been illustrated by a detailed description of the preferred embodiment, it will be known to those of skill in the art that various changes in form and detail can be made without departing from the true scope of the invention. The invention should not be limited to the foregoing preferred embodiment.

We claim:

1. A border assembly for a mattress or the like comprising:

a foam rail sleeve having a side wall and an end wall;

a hollowed inner core defined by said sleeve; and a plurality of springs arranged in a row, said row having a top, a bottom, and left and right sides, said row held completely within the core so that the row of springs is surrounded on top, bottom, left and right sides by the foam of the sleeve.

2. The border assembly of claim 1, wherein the foam rail sleeve is slitted along its length through the side wall to facilitate insertion of the row of springs into the core.

3. The border rail assembly of claim 2 wherein the slit is cut at an angle other than perpendicular to the side wall of the rail.

4. The border rail assembly of claim 3, wherein the slit is cut in the side wall of the rail at an angle of between about 20 to 70 degrees.

5. The border rail assembly of claim 4, wherein the slit is cut in the side wall of the rail at an angle of between about 40 to 50 degrees.

6. The border rail assembly of claim 3, wherein the slit portions of the side wall of the rail are sealed together at the slit.

7. The border rail assembly of claim 1, wherein the foam rail sleeve defines a hollow inner core along the entire length of the sleeve leaving an opening through the end wall and a foam plug is inserted into the opening in the end wall to seal the core.

8. The border rail assembly of claim 1, wherein the row of springs is encased in a sheet cover with each spring held within a pocket formed in said cover.

9. A mattress, comprising:

a body supporting section joined to a plurality of border rail assemblies each of said border rail assemblies having a foam rail sleeve with a side wall and an end wall, a hollowed inner core defined by said sleeve; and a plurality of springs arranged in a row, said row having a top, a bottom, and left and right sides, said row of springs held completely within the core so that the row of springs is surrounded on top, bottom, left and right sides by the foam of the sleeve.

10. The mattress of claim 9, wherein the foam rail sleeve is slitted along its length through the side wall to facilitate insertion of the row of springs into the core.

11. The mattress of claim 10, wherein the slit is cut at an angle other than perpendicular to the side wall of the rail.

12. The mattress of claim 11, wherein the slit is cut in the side wall of the rail at an angle of between about 20 to 70 degrees.

13. The mattress of claim 12, wherein the slit is cut in the side wall of the rail at an angle of between about 40 to 50 degrees.

14. The mattress of claim 11, wherein the slit portions of the side wall of the rail are sealed together at the slit.

15. The mattress of claim 9, wherein the foam rail sleeve defines a hollow inner core along the entire length of the sleeve leaving an opening through the end wall and a foam plug is inserted into the opening through the end wall to seal the core.

16. The mattress of claim 9, wherein the row of springs is encased in a sheet cover with each spring held within a pocket formed in said sheet cover.

17. A method of making a border assembly for a mattress or the like, comprising:

forming a foam rail sleeve having a side wall and an end wall and a hollowed inner core;

cutting a slit along the length of the side wall of the foam rail sleeve;

inserting into the hollow inner core of the sleeve a plurality of springs arranged in a row, said row having a top, a bottom, and left and right sides; and sealing together the slit portions of the side wall of the rail.

18. The method of making a border assembly of claim 17, wherein the foam rail sleeve is formed with a hollowed inner core along the entire length of the sleeve leaving an opening through the end wall and the opening in the end wall is plugged by a foam plug after the row of springs is inserted into the core.

19. The method of making a border assembly of claim 17, wherein the slit is cut through the side wall of the rail at an angle other than substantially perpendicular to the side wall.

20. The method of making a border assembly of claim 19, wherein the blade is set at an angle of about 20 to 70 degrees to the side wall of the rail.

21. The method of making a border assembly of claim 20, wherein the blade is set at an angle of about 40 to 50 degrees to the side wall of the rail.

22. The method of claim 17, further comprising:

encasing the row of springs in a cover sheet with each spring held within a pocket of said cover sheet.

23. The method of claim 17, further comprising:

joining the border rail assembly to a body-supporting section to form a mattress.

* * * * *